US007975765B2

(12) United States Patent
Manson

(10) Patent No.: US 7,975,765 B2
(45) Date of Patent: Jul. 12, 2011

(54) ENCLOSED CIRCULATION TOOL FOR A WELL

(75) Inventor: Ken Manson, Bonnyville (CA)

(73) Assignee: Logan Completion Systems Inc., Calgary, Alberta (CA)

( * ) Notice: Subject to any disclaimer, the term of this patent is extended or adjusted under 35 U.S.C. 154(b) by 0 days.

(21) Appl. No.: 12/234,568

(22) Filed: Sep. 19, 2008

(65) Prior Publication Data

US 2009/0078422 A1 Mar. 26, 2009

(30) Foreign Application Priority Data

Sep. 20, 2007 (CA) ..... 2621041

(51) Int. Cl.
*E21B 21/00* (2006.01)

(52) U.S. Cl. ..... 166/312; 166/177.7; 166/68; 166/105; 166/167

(58) Field of Classification Search ..... 166/312, 166/177.7, 68, 105, 167
See application file for complete search history.

(56) References Cited

U.S. PATENT DOCUMENTS

| | | | | |
|---|---|---|---|---|
| 2,704,579 | A * | 3/1955 | Brown | 166/312 |
| 4,190,113 | A | 2/1980 | Harrison | |
| 4,534,426 | A | 8/1985 | Hooper | |
| 4,671,359 | A | 6/1987 | Renfro | |
| 4,681,164 | A | 7/1987 | Stacks | |
| 4,705,107 | A | 11/1987 | Council | |
| 4,744,420 | A | 5/1988 | Patterson | |
| 5,033,545 | A | 7/1991 | Sudol | |
| 5,178,223 | A | 1/1993 | Smet | |
| 5,285,204 | A | 2/1994 | Sas-Jaworsky | |
| 5,447,200 | A * | 9/1995 | Dedora et al. | 166/311 |
| 5,611,397 | A * | 3/1997 | Wood | 166/68 |
| 5,853,056 | A | 12/1998 | Landers | |
| 6,050,352 | A | 4/2000 | Thompson | |
| 6,173,771 | B1 | 1/2001 | Eslinger | |
| 6,367,566 | B1 | 4/2002 | Hill | |
| 6,789,626 | B2 | 9/2004 | Wagg | |
| 6,966,375 | B2 | 11/2005 | Pluchek | |
| 7,090,018 | B2 | 8/2006 | Livingstone | |
| 2003/0141111 | A1 | 7/2003 | Pia | |
| 2003/0173088 | A1 | 9/2003 | Livingstone | |
| 2004/0079553 | A1 | 4/2004 | Livingstone | |
| 2005/0045337 | A1 * | 3/2005 | Bansal et al. | 166/369 |

* cited by examiner

*Primary Examiner* — Jennifer H Gay
*Assistant Examiner* — Yong-Suk Ro
(74) *Attorney, Agent, or Firm* — Gardere Wynne & Sewell LLP

(57) ABSTRACT

An enclosed circulation tool for a well including a tubular body having a top end, a bottom end and an interior cavity. A progressive cavity pump positioned at the bottom end of the body, the pump having a rotor mounted within a stator. The rotor has an upper end and a lower end, with the upper end extending into the interior cavity. A drive is coupled to and adapted to rotate the rotor in order to draw sand into the interior cavity. A first fluid passage is provided along which fluids from pumped from surface pass to fluidize solids within the interior cavity. A second fluid passage is provided along which fluidized solids from within the interior cavity pass to surface.

6 Claims, 4 Drawing Sheets

ENCLOSED CIRCULATION TOOL FOR A WELL

FIELD

The present invention relates to an enclosed circulation tool which is used to remove solids or fluids from the bottom of oil wells.

BACKGROUND

Sand accumulations tend to choke off production in an oil well. U.S. Pat. No. 5,033,545 (Sudol) is an example of a enclosed circulation tool that is presently used to remove sand from oil wells.

SUMMARY

There is provided an enclosed circulation tool for a well including a tubular body having a top end, a bottom end and an interior cavity. A progressive cavity pump positioned at the bottom end of the body, the pump having a rotor mounted within a stator. The rotor has an upper end and a lower end, with the upper end extending into the interior cavity. A drive is coupled to and adapted to rotate the rotor in order to draw sand into the interior cavity. A first fluid conduit is provided along which fluids from pumped from surface pass to fluidize solids within the interior cavity. A second fluid conduit is provided along which fluidized solids from within the interior cavity pass to surface.

BRIEF DESCRIPTION OF THE DRAWINGS

These and other features will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
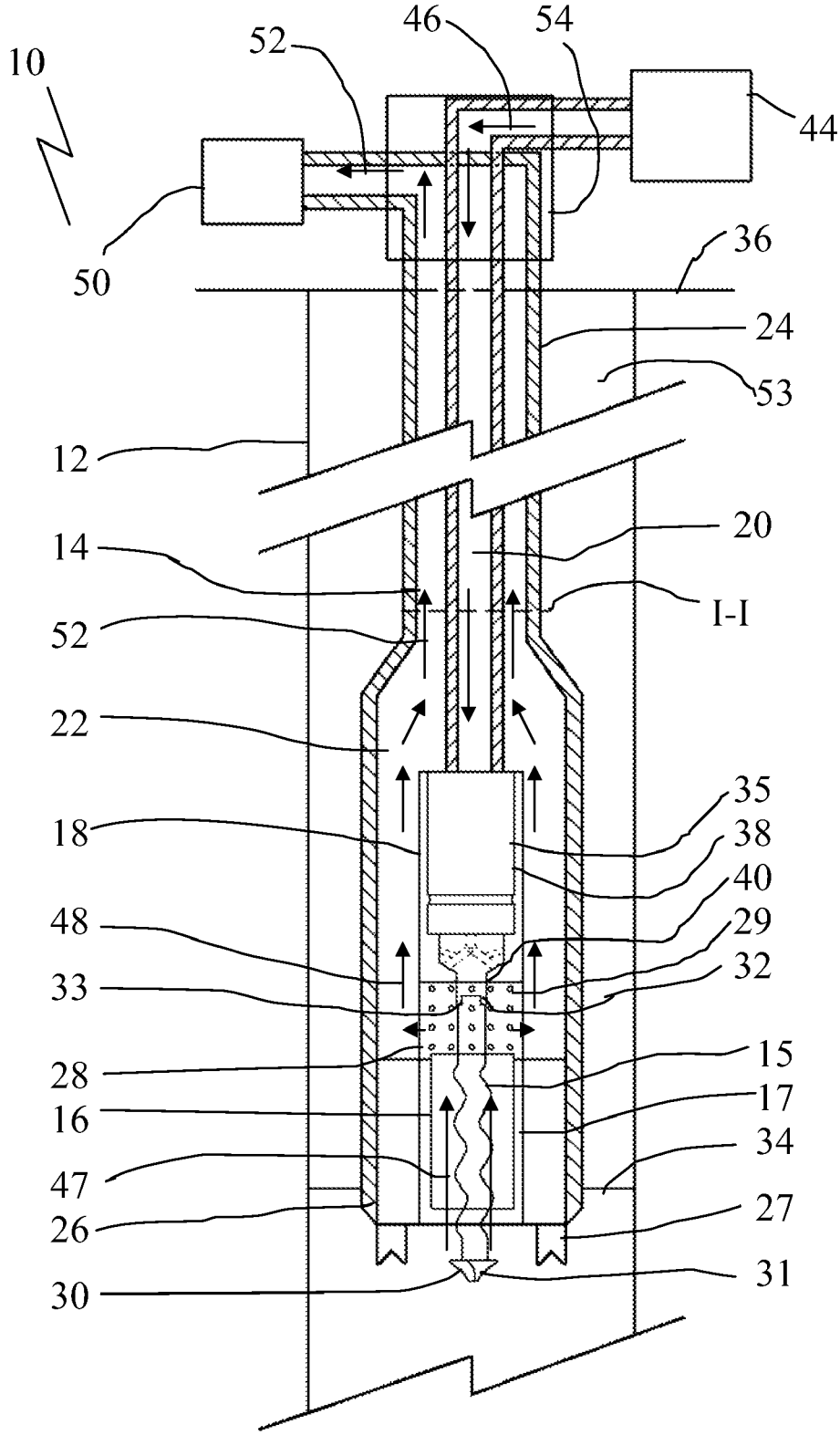
FIG. 1 is a side elevation view, in section, of an enclosed circulation tool.

An enclosed circulation tool generally identified by reference numeral 10, will now be described with reference to FIGS. 1 through 5.

Structure and Relationship of Parts:

FIG. 1 describes an enclosed circulation tool 10 for a well 12. Enclosed circulation tool 10 consists of a tubular body 14, a pump 16, a drive 18, a first fluid passage or conduit 20 and a second fluid passage or conduit 22. Tubular body 14 has a top end 24, a bottom end 26 and an interior cavity 28. Bottom end 26 is substantially closed, and may have shoes 27.

Pump 16 is preferably a moineau progressive cavity pump as shown, having a rotor 15 and a stator 17. An agitator, such as mixing blade 30, is mounted at a lower end 31 of and rotates with rotor 15. Lower end 31 of rotor 15 protrudes from bottom end 26 of body 14. A universal joint 32 connects an upper end

Figure 2:
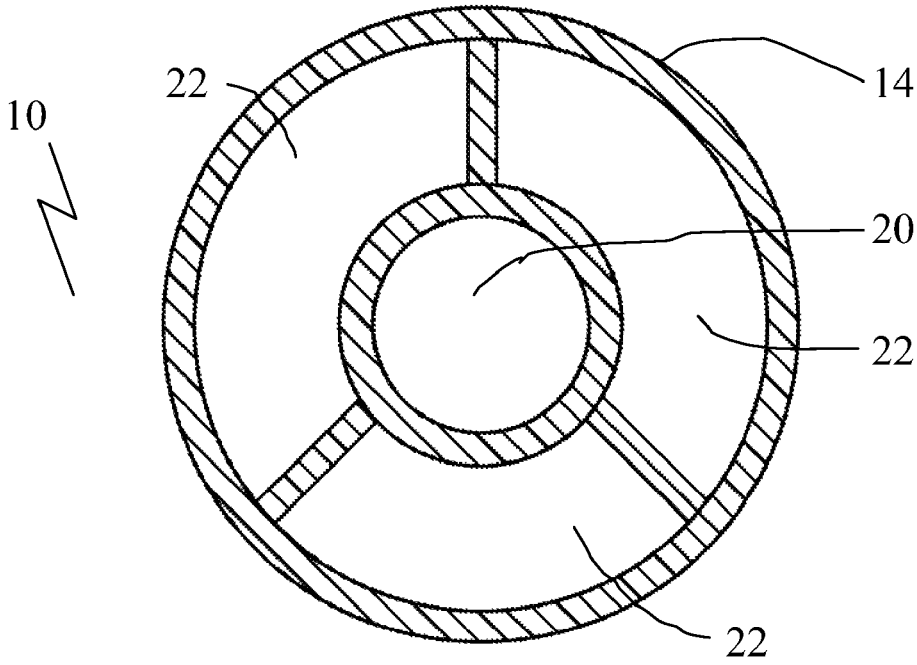
FIG. 2 is a cross section of the enclosed circulation tool of FIG. 1, sectioned along line I-I from FIG. 1.

33 of rotor 15 to drive 18 within interior cavity 28. Drive 18 is coupled to rotor 15 and adapted to drive pump 16 in order to draw sand 34 into interior cavity 28. For the purpose of illustration, sand 34 is shown as a layer in well 12, although sand 34 may be any type of solids or debris that need to be cleaned out of well 12. It will be appreciated that instead of sand 34, well bore fluids may be drawn into interior cavity 28 and carried to surface. Drive 18 is a fluid activated drive 35 activated by fluids pumped from surface 36. First fluid passage 20 is provided along which fluids pumped from surface 36 pass in order to fluidize solids within interior cavity 28. Interior cavity 28 has holes 29 used to transfer fluidized solids into second fluid passage 22. Holes 29 may have various sizes, depending on the type of debris being cleaned out of well 12. In one example, large holes may be employed to clean out well 12 if large particulate matter is present, as opposed to fine sand. Second fluid passage 22 is provided along which fluidized solids from within interior cavity 28 pass to surface 36. First and second fluid passages 20 and 22, respectively, make up part of a concentric tubing string 53. Referring to FIG. 2, the relationship between first fluid passage 20 and second fluid passage 22 is illustrated. As detailed in FIG. 3, fluid activated drive 35 is a moineau motor 38 (also known as a mud motor). Moineau motor 38 has a rotor 40 and a stator 42. Fluids passing through moineau motor 38 causes relative rotation of rotor 40 and stator 42. Referring to FIG. 1, rotor 40 is coupled to rotate rotor 15.

A pump 44 is positioned on surface 36 to pump fluid down first fluid passage 20. Arrows 46 indicate the flow of fluid through first fluid passage 20, while arrows 47 indicate the flow of sand and other solid debris being drawn up by pump 16. Arrows 48 indicate the flow of fluid and fluidized solids from interior cavity 28 into second fluid passage 22. A pump 50 may be positioned on surface 36 to pump fluid and fluidized solids from second fluid passage 22 out of well 12. Arrows 52 indicate the flow of fluid through second fluid passage 22 and out of well 12. FIG. 2 shows a cross section of tubular body 14 taken from section I-I from FIG. 1. FIG. 2 shows the arrangement of first fluid passage 20 and second fluid passage 22, although other arrangements that facilitate the flow of fluid through tool 10 may be used instead of the one shown.

Figure 4:
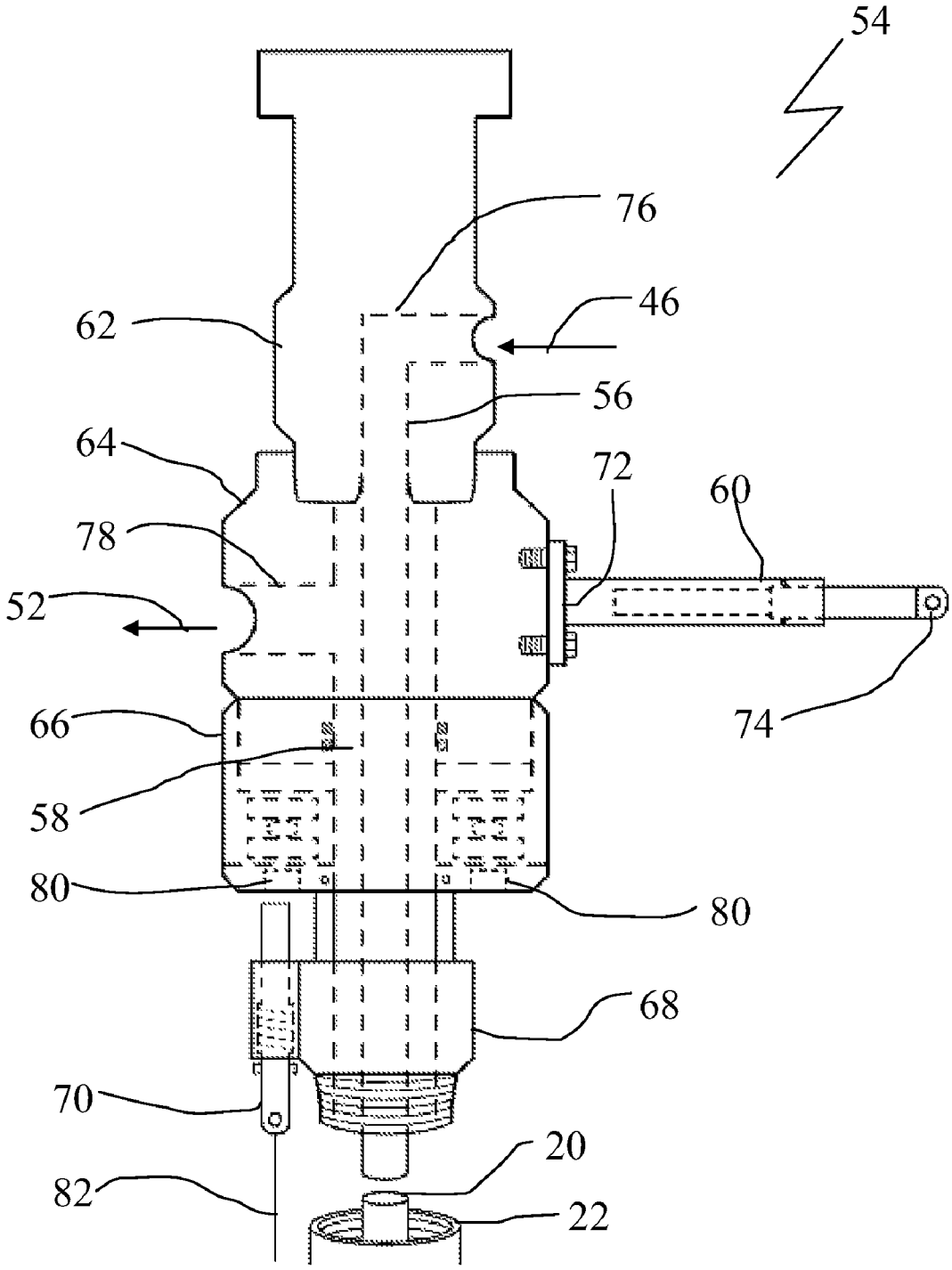
FIG. 4 is a side elevation view, in section, of the anti-torque swivel head from the enclosed circulation tool of FIG. 1.

Referring to FIG. 1, an anti-torque swivel head 54 is connected at the surface to first and second fluid passages 20 and 22, respectively. Referring to FIG. 4, swivel head 54 is shown in more detail. Swivel head 54 consists of a first fluid line 56, a second fluid line 58, an anchor arm 60, a first portion 62, a second portion 64, a third portion 66, a tubing string connection 68 and a locking pin 70. Swivel head 54 is built for the purpose of being able to prevent concentric tubing string 53 from rotating while a drilling motor assembly (not shown) is being used with concentric tubing string 53. Fluid used with enclosed circulation tool 10 circulates through swivel head 54 through first and second fluid lines 56 and 58, respectively, which connect to first and second fluid passages 20 and 22, respectively. A first end 72 of anchor arm 60 is secured to second portion 64. A second end 74 of anchor arm 60 is anchored (not shown) to the rig, a deadline, anchorline, or the ground in order to prevent first, second, and third portions 62, 64, and 66, respectively, from rotating. First portion 62 may be provided as a pickup sub which may be attached to the rig and used to support swivel head 54. First portion 62 also contains a fluid inlet 76 which may connect to pump 44 (not shown). First portion 62 is threadably connected to second portion 64. Fluids from second fluid line 58 are prevented from flowing into first portion 62. Second portion 64 has a fluid outlet 78 which may connect second fluid line 58 to pump 50. Second portion 64 is threadably connected to third portion 66. Third portion 66 is load bearing and is sealably and rotatably connected to tubing string connection 68. Tubing string connection 68 is threadably securable to concentric tubing string 53. It should be understood that first, second, and third portions 62, 64, and 66 may be provided as a single piece. Locking pin 70 is provided on tubing string connection 68, locking pin 70 being spring biased into engagement with a slot 80 positioned on third portion 66. There may be provided a series of slots 80, as shown. When locking pin 70 is engaged into one of slots 80, concentric tubing string 53 is unable to rotate relative to swivel head 54. When locking pin 70 is pulled down to disengage slot 80, concentric tubing string 53 is free to rotate relative to swivel head 54. A rope 82 may be provided to allow locking pin 70 to be disengaged from a distance. Locking pin 70 is shown being engaged/disengaged manually in FIG. 4. Alternatively, locking pin 70 can be engaged or disengaged by automatic means, as for example using a hydraulic clutch system (not shown) built inside swivel head 54. Because swivel head 54 is anchored to the rig and thus prevented from rotating, when locking pin 70 is engaged with slot 80 concentric tubing string 53 is unable to rotate. Swivel head 54 allows fluids to continue circulating through first and second fluid lines 56 and 58, respectively, when tubing string 53 is rotating or stationary.

Figure 5:
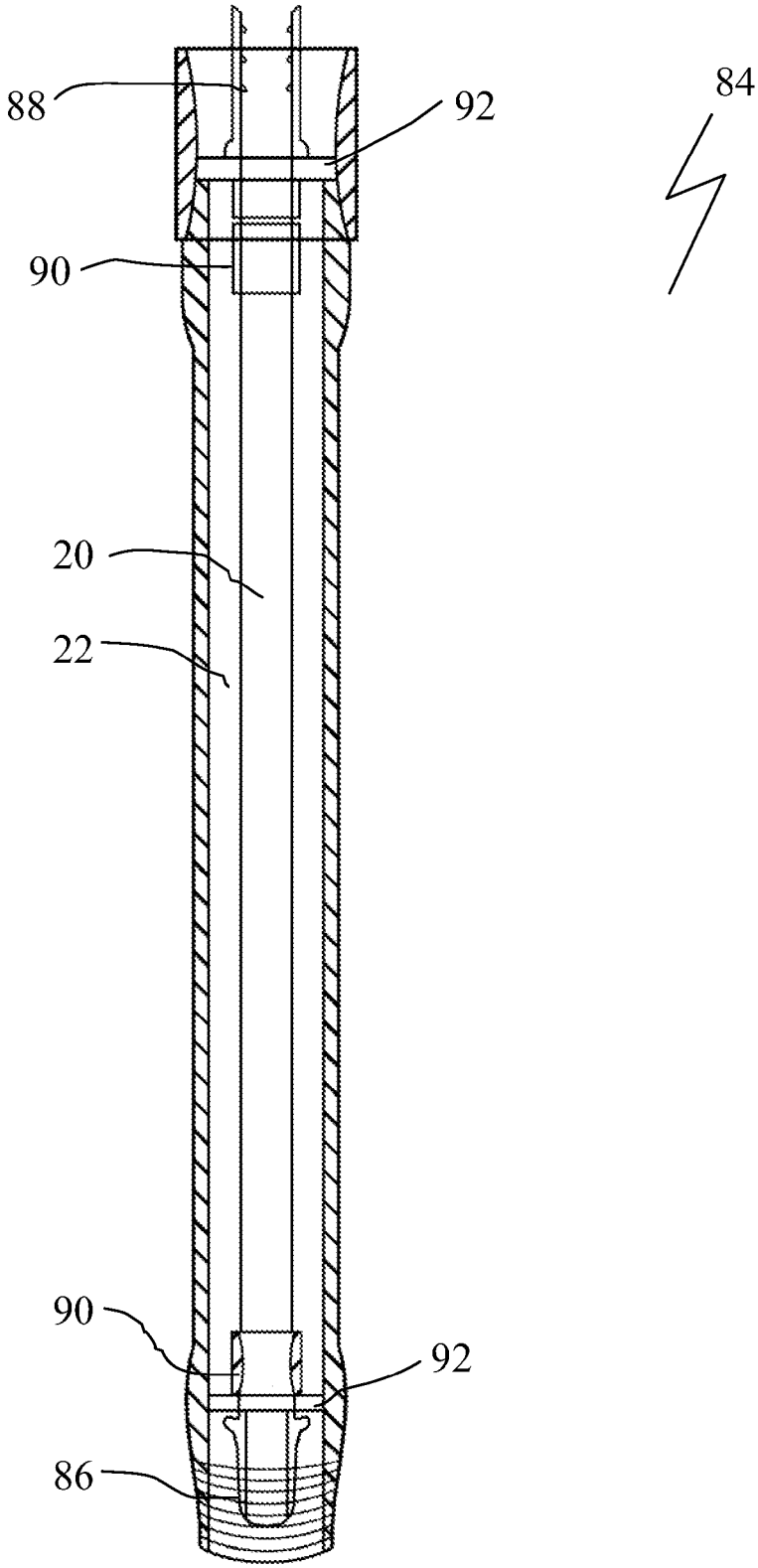
FIG. 5 is a partially transparent side elevation view of a section of the tubular housing.

FIG. 5 shows an example of a section 84 that may be used to form of tubular body 14. Section 84 has first and second fluid passages 20 and 22, respectively, and is designed to connect with other sections using male stab-in connector 86 and female stab-in connector 88. Male and female stab-in connectors 88 are coupled to first fluid passage 20 by couplers 90. Section 84 also has centralizers 92 at the top and bottom that help maintain first fluid passage 20.

Figure 3:
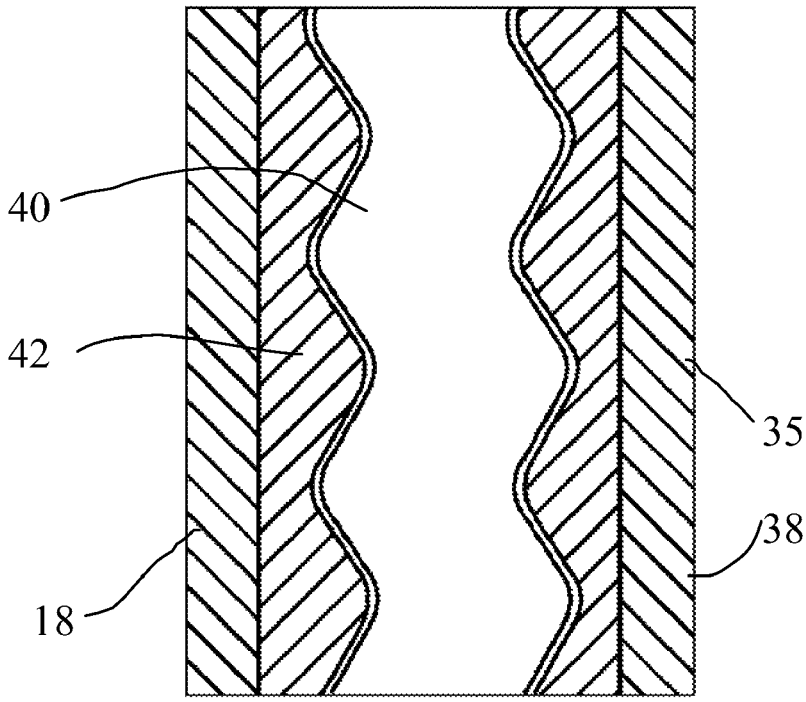
FIG. 3 is a side elevation view, in section, of the motor from the enclosed circulation tool of FIG. 1.

Operation:

Referring to FIG. 1, in order to clean out sand 34 from well 12, enclosed circulation tool 10 is lowered into well 12. Alternatively, enclosed circulation tool 10 may also be passed down an existing drillstring (not shown). Shoes 27 help to secure tubular body 14 within well 12 and prevent unwanted rotation. Fluid is then pumped through first fluid line 56 (shown in FIG. 4) into first fluid passage 20, using pump 44 to pump fluid in the direction indicated by arrows 46. The type of fluid may vary, although common fluids used in a sand clean out include water separated from recovered crude oil. Referring to FIG. 3, as the fluid flows through moineau motor 38, it turns rotor 40. Referring to FIG. 1, rotor 40 then rotates rotor 15 through universal joint 32. Mixing blade 30 and rotor 15 of pump 16 draw sand 34 from well 12 up and into interior cavity 28, in the direction indicated by arrows 47. While in interior cavity 28, sand 34 is mixed and fluidized with the fluid being passed down through first fluid passage 20. Upon becoming agitated and fluidized, a mixture of fluids and fluidized solids are formed, which then jet out through holes 29 and into second fluid passage 22. The direction of the flow of the fluidized solids and fluid from interior cavity 28 into second fluid passage 22 are indicated by arrows 48. The fluidized solids and fluid then pass up tubular body 14 through second fluid passage 22 in the direction indicated by arrows 52, where they exit well 12 at surface 36 and pass through second fluid line 58 (shown in FIG. 4). Pump 50 may be employed in order to provide additional pumping force on the fluids exiting well 12 through second fluid passage 22, so that lower fluid pressures can be used from pump 44. This is advantageous, as it reduces the overall fluid pressure at bottom end 26, which prevents any fluid from being forced into the formation being drilled. In one example, a pressure of 500 psi is applied to fluid at surface 36 by pump 44. This pressure will result in a weight of 800 psi at interior cavity 28 of enclosed circulation tool 10. The design of enclosed circulation tool 10 is such that there is a greatly reduced chance of any fluid being forced into the formation being drilled in comparison with traditional clean out techniques, because sand 34 is first drawn up into interior cavity 28 before being subjected to fluid pressure. This way, the formation is subjected to very little fluid pressure.

Fluid is passed through enclosed circulation tool 10 until no more sand 34 can be removed from well 12 at the current depth. Over the normal course of a well clean out, when no more sand 34 can be removed at a certain depth, enclosed circulation tool 10 is then lowered further, in order to clean out sand 34 lower down in well 12. This process is repeated until well 12 is sufficiently clear of solid debris from drilling so that normal drilling operations may be carried out. Clean out tool 10 is designed to draw up fluid consisting of up to 80% sand, or other debris. Enclosed circulation tool 10 may also be used for the production of oil, water, or any type of well fluid. This may be accomplished using the above description with well fluids being removed instead of sand. Tool 10 may be permanently or temporarily installed, depending on the application.

Tool 10 is advantageously used with wells that have low fluid levels with unattainable circulation. This type of well typically absorbs any fluids sent downhole for pumping purposes or otherwise.

Tool 10 can be installed in or retrieved from a well or a main production string using wireline, rods, coiled tubing or regular tubing. It can be installed/retrieved in separate components or as a whole. In addition, it may be assembled downhole.

Additionally, tool 10 may be used for well-testing.

Advantages:

With enclosed circulation tool 10, sand 34 is first drawn into interior cavity 28 by pump 16 and then fluidized so it can be removed to surface 36. With the prior art, sand 34 was fluidized in the well bore 12 and there was a danger of forcing sand 34 into cracks in the formation. When sand 34 is forced into cracks in the formation, it either plugs off the well reducing well efficiency or quickly falls out again forcing you to go back in and clean it out again. As you need not be concerned with forcing sand 34 into the formation with enclosed circulation tool 10, you can use fluids at higher pressures.

Variations:

Drive 18 used to rotated pump 16 is illustrated as being a moineau mud motor 38 having a rotor 40 and a stator 42. It would be possible to use other types of drive 18. For example, if electric power cables were available, for example extending to a measurement while drilling (MWD) tool positioned in the drill string, an electric drive could be used. Alternatively, a screw auger (not shown) could be used in place of pump 16.

Cautionary Warnings:

The enclosed circulation tool may not be suitable for all types of formations. If chunks of rock become jammed in the pump 16 intake, it could prevent the pump from rotating.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiments without departing from scope of the Claims.

What is claimed is:

1. An enclosed circulation tool for a well, comprising:

a tubular body having a top end, a bottom end and an interior cavity;

a progressive cavity pump carried by the body and positioned at the bottom end of the body, the pump having a rotor mounted for rotation within a stator, the rotor having an upper end and a lower end, the upper end extending into the interior cavity;

a drive coupled to drive the rotor, the rotor drawing solids or fluids into the interior cavity;

a first fluid conduit in the tubular body along which circulation fluids pass from the earth's surface to the interior cavity; and a second fluid conduit in the tubular body along which the circulation fluids and the solids or fluids pass from the interior cavity to the earth's surface.

2. The enclosed circulation tool of claim 1, wherein the lower end of the rotor extends past the bottom end of the body and an agitator is secured to the lower end of the rotor.

3. The enclosed circulation tool of claim 1, wherein the drive is a fluid activated drive activated by fluids pumped from the earth's surface.

4. The enclosed circulation tool of claim 2, wherein the rotor is a first rotor and the fluid activated drive is a moineau motor having a second rotor and a second stator, the second rotor being coupled to the first rotor such that rotation of the second rotor results in rotation of the first rotor.

5. The enclosed circulation tool of claim 1, wherein an anti-torque swivel head is sealably and rotatably connected to the first fluid conduit and the second fluid conduit at the earth's surface, and wherein the anti-torque swivel head is having a locked and an unlocked position, the anti-torque swivel head configured to prevent the enclosed circulation tool from rotating when in the locked position.

6. A method of removing solids or fluids in a well, comprising:

providing an enclosed circulation tool, the enclosed circulation tool comprising:

a tubular body having a top end, a bottom end and an interior cavity;

a progressive cavity pump carried by the body and positioned at the bottom end of the body, the pump having a rotor mounted for rotation within a stator, the rotor having an upper end and a lower end, the upper end extending into the interior cavity;

a drive to rotate the rotor;

a first fluid conduit connected to the tubular body and along which fluids pumped from the earth's surface pass into the interior cavity;

a second fluid conduit connected to the tubular body and along which fluids from within the interior cavity pass to the earth's surface;

positioning the enclosed circulation tool in a well;

rotating the rotor such that solids or fluids are drawn into the interior cavity;

pumping circulation fluids along the first fluid conduit to the interior cavity and along the second fluid conduit from the interior cavity, such that the solids or fluids drawn into the interior cavity are circulated through the second fluid conduit.

* * * * *